United States Patent [19]

Stephenson et al.

[11] Patent Number: 4,693,313

[45] Date of Patent: Sep. 15, 1987

[54] INSULATED WELLBORE CASING

[75] Inventors: Edgar O. Stephenson, Pierce County; Raymond C. Howe, King County, both of Wash.

[73] Assignee: Kawasaki Thermal Systems, Inc., Tacoma, Wash.

[21] Appl. No.: 878,996

[22] Filed: Jun. 26, 1986

[51] Int. Cl.[4] ..... E21B 36/00; E21B 43/24

[52] U.S. Cl. ..... 166/302; 166/57; 166/242; 166/380

[58] Field of Search ..... 166/302, 57, 242, 380, 166/303, 901, 285; 139/114, 111, 113, 149; 29/446

[56] References Cited

U.S. PATENT DOCUMENTS

| | | | |
|---|---|---|---|
| Re. 28,152 | 9/1974 | Waters | 166/57 |
| 3,397,745 | 8/1968 | Owens et al. | 166/57 |
| 3,456,735 | 7/1969 | McDougall et al. | 166/304 |
| 3,511,282 | 5/1970 | Willwhite et al. | 138/113 |
| 3,608,640 | 9/1971 | Willhite et al. | 166/57 X |
| 3,650,327 | 3/1972 | Burnside | 166/303 |
| 3,680,631 | 8/1972 | Allen et al. | 166/242 X |
| 3,722,591 | 3/1973 | Maxson | 166/295 |
| 3,749,163 | 7/1973 | Waters | 166/57 |
| 3,762,469 | 10/1973 | Babb | 166/57 |
| 3,763,931 | 10/1973 | Waters | 166/57 |
| 3,763,935 | 10/1973 | Perkins | 166/57 X |
| 3,820,605 | 6/1974 | Barber et al. | 166/57 X |
| 4,024,919 | 5/1977 | Pujol | 166/303 |
| 4,139,024 | 2/1979 | Adorjan | 138/149 |
| 4,296,814 | 10/1981 | Stalder et al. | 166/303 |
| 4,332,401 | 6/1982 | Stephenson et al. | 285/47 |
| 4,403,656 | 9/1983 | Ploeg et al. | 166/179 |
| 4,415,184 | 11/1983 | Stephenson et al. | 285/47 |
| 4,480,371 | 11/1984 | McStravick et al. | 138/149 X |
| 4,496,001 | 1/1985 | Sigworth, Jr. | 166/387 |
| 4,512,721 | 4/1985 | Ayres et al. | 166/57 X |

FOREIGN PATENT DOCUMENTS

| | | |
|---|---|---|
| 1169765 | 8/1980 | Canada . |
| 646026 | 8/1979 | U.S.S.R. . |

*Primary Examiner*—Stephen J. Novosad
*Attorney, Agent, or Firm*—Seed and Berry

[57] ABSTRACT

An insulated well casing is described that includes an inner tubular member and an outer tubular casing member joined together at their ends by a weldment, typically formed into a thrust cone suitable for joining strings of insulated casings to insulate and encase the entire depth of a well for delivery of steam, for example, into a producing formation. A key element of the invention is pre-stressing the integrated casing by tensioning the inner tubular member at a level less than the yield strength of the tubular material prior to joining the weldments of the unit together. The resulting integrated casing includes a tensioned inner tubular member and an outer member that is in compression. The tensioning load is selected such that at well operating temperatures and pressures, the compressive stresses exerted upon the casing at the bottom of the hole approach the compressive yield strengt of the inner tubular member, but leave a desired margin of safety. The casing of the invention permits injecting high-temperature steam at 450°-700° F. adjacent the insulated casing and recovering product from the formation through a central annular uninsulated tubing. The temperature and stress experienced by the outer tubular casing member, grouted to the wellbore are such that the adhesive bonds between the casing and the formation remain intact and the casing is not significantly deformed. The insulated casing of the invention reduces heat loss from the injected steam to the surrounding formations to less than 1%.

8 Claims, 2 Drawing Figures

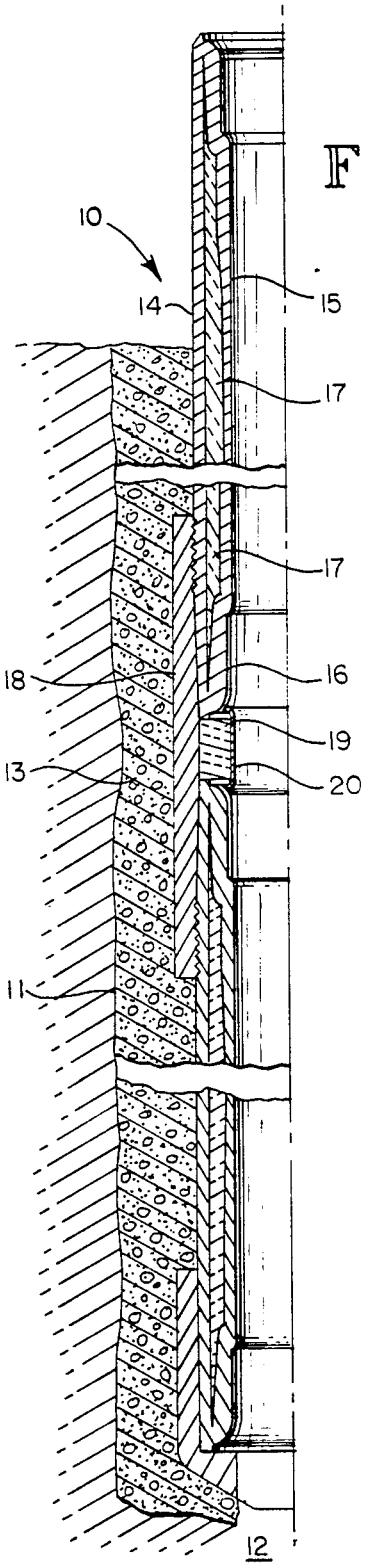
FIG. 1
FIG. 2
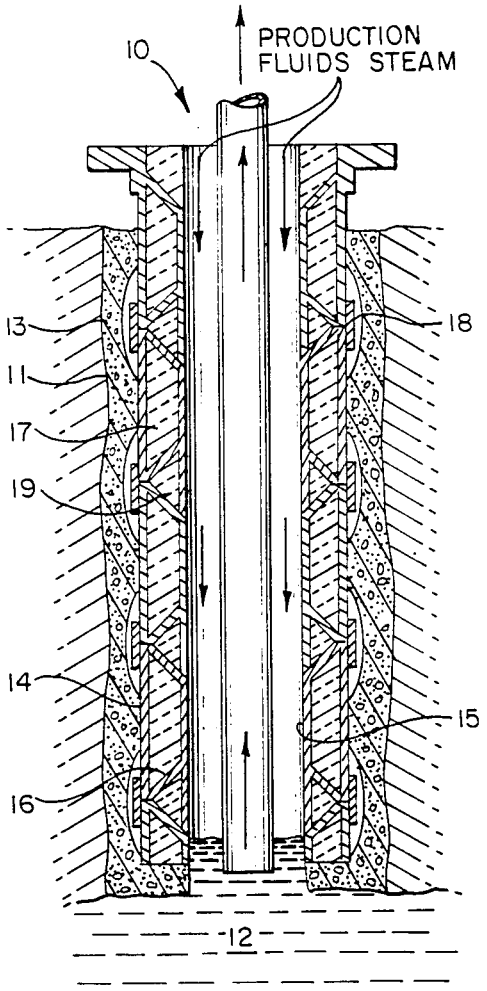

INSULATED WELLBORE CASING

DESCRIPTION

1. Technical Field

The field of the invention relates to steam injection systems for delivering hot pressurized steam downhole in an oil wellbore. More particularly, the invention relates to an insulated well casing that is bonded along its length to a wellbore to present loss of heat fluids into adjacent earth formations by controlling heat transfer through the casing from high temperature fluids in the well.

2. Background of the Invention

In conventional well casings, a string of steel tubular members coupled together extends downwardly from the surface to a particular oil bearing formation and is cemented to the wellbore throughout the depth of the well. The casing string is cemented to the wellbore, forming a seal that prevents the uncontrolled escape of oil, gas or other operating fluids into the surrounding formations. The cement bond between the casing and the wellbore is such that the casing is substantially totally restrained by the bonding material or cement. As a result, natural thermal expansion of the casing in response to increased well operating temperatures as when steam is injected, is prevented, placing high compressive loads on the casing. In order to prevent a structural failure of the casing, care must be exercised to isolate the casing from thermally induced stresses which might exceed the yield strength of the casing tubular members.

Many wells in oil production operate at relatively low temperature differentials. Such differentials, on the order of 30°-100°0 F., generate axial stresses on the casing members of about 20,000 psi. These stress levels are easily accommodated by the mechanical characteristics and materials of the casing. However, where well operation calls for steam injection into a well, for example, well fluids at temperatures on the order of 450°-700° F. may contact the casing. Under said conditions, temperature differentials and the resulting linear thermal expansion of the casing could generate stresses greater than conventional casing yield strength of 55,000 psi. In addition, heat losses through the conventionally uninsulated casing walls into the adjacent formations from hot well operating fluids such as steam may exceed 25% of the energy input, substantially adversely affecting well operation.

Where steam is to be injected into a well, many operations employ steam injection tubing that is insulated and separated from the wellbore casing by means of a seal at the bottom of the hole called a "packer" designed to seal off the wellbore annulus between the insulated injection tubing string and the uninsulated wellbore casing. Such well systems are described by Barber et al. in U.S. Pat. No. 3,820,605.

In some wells the bottom hole packer is avoided by extending the steam injection tubing down to the formation and providing a high-pressure gas pack in the annulus between the injection tubing and the casing. The gas pressurization system often experiences a loss of gas pressure causing hot fluids to flow into the annulus and contact the well casing. The resulting stress on the casing, in response to the increased temperature and resulting thermal linear expansion, may buckle or deform the casing or fracture the bond between the casing and wellbore cement.

A temperature reversal will also cause failure of an insulated tubular system that is pre-tensioned to accommodate a hot, coaxially flowing fluid as described by Willhite et al. in U.S. Pat. No. 3,608,640. Contact of a hot fluid with the external supporting member of the Willhite system may cause the internal member to fail as it is unexpectedly tensioned.

Systems which employ insulation adjacent the casing are not structurally integrated with the casing, and thus subject to structural failure through infiltration of.well operating fluids.

None of the well casing used with steam injection technology known to date provides satisfactory steam injection capability without risk of casing failure or excessive heat losses.

DISCLOSURE OF THE INVENTION

It is an object of the invention to provide an insulated wellbore casing system or unit in which an outer casing tubular member is rigidly bonded to the wellbore adjacent earth formations such that the earth formations are not contacted by hot well operating fluids or steam. The insulated casing of the invention is protected by means of an insulating material layer and an insulation containment system, all joined together such that the insulated casing acts as an integral unit both structurally and thermally.

It is an object of the invention to provide an insulated casing wherein the insulation becomes located at the outer periphery of the well providing an entirely open interior central core area of the well for injecting steam downwardly and simultaneously producing upward flow of oil. It is an object of the invention to provide an insulated wellbore casing system that permits handling of steam or hot fluids up to 700° F. without exceeding stress limits of the casing tubular members of joining weldments.

The insulated integral wellbore casing of the invention includes an outer tubular member that is bonded to the wellbore formation. An inner tubular member is concentrically spaced from the outer member and includes terminal ends substantially adjacent the outer tubular member ends. The assembly forms an annular cavity between the inner and outer tubular members. An insulating material fills the annular cavity between the inner and outer tubular members. The tubular members are joined at their adjacent ends by means of weldments. The weldments are conventionally formed into thrust cone configurations that allow coupling the insulated wellbore casings into a casing string that lines the entire wellbore depth. The weldments are joined to the inner and outer tubular members while the inner tubular member is tensioned wherein an integrated casing unit is formed that is pre-stressed to accommodate linear thermal expansion of the inner tubular member at wellbore operating temperatures. The inner tubular member is pre-stressed at a tension adjusted to less than the yield strength of the tube such that at operating temperatures, compression stress exerted on the confined inner tubular member is less than the compression yield strength of the tubular material.

In one embodiment, tension stressing is achieved by welding the inner and outer tubular members together at one end and then subjecting the unsecured inner tubular member to mechanical loading that exerts a tensioning stress on the tubular member sufficient to accommodate compressive stress at well operating conditions. The completed integral insulated wellbore casing as manufactured includes an inner tubular member that is tensioned and the outer casing tubular member that is under compression.

The tubular material from which the integrated casing of the invention is manufactured is selected based upon its inherent mechanical quality. The mechanical characteristics are selected and balanced with the intended maximum operating temperature such that none of the individual tubular members or weldments exceed yield strength under well operating conditions. The insulated wellbore casing of the invention is particularly suited for steam at 450°–700° F. adjacent the inner tubular member.

BRIEF DESCRIPTION OF THE DRAWINGS

FIG. 1 shows the integrated insulated casing of the invention in longitudinal section.

FIG. 2 shows the insulated casing of the invention installed in a well bore wherein steam is injected into a reservoir formation.

BEST MODE FOR CARRYING OUT THE INVENTION

Referring to FIGS. 1 and 2, insulated casings 10 of the invention are shown coupled together to form a continuous insulated casing string fitted into a wellbore 11 that extends from the earth's surface into a formation of interest, such as an oil bearing reservoir 12, as shown in FIG. 2, for example. The casing string is designed to become an integral part of the wellbore structure and thus is bonded by means of cement or grout 13 to the earth, soil and rock formations along substantially the entire length of the wellbore down to the formation of interest. The casing is designed to present leakage of fluid from the well into surrounding formations and limit heat losses from well fluids into the surrounding formations.

Each section of the insulated casing includes an outer tubular member 14 that upon installation in the wellbore will be rigidly bonded adhesively or mechanically to the wellbore by means of the grout 13. The outer tubular 14 may be of any convenient diameter, typically 4–12 inches OD, and constructed of standard steel tubular conduit suitable for oil field use, such as API J55, K55, N80, etc. The tubular material, characterized by yield strength, resistance to corrosion, and other known factors, is selected depending upon well depth, operating temperature range and wellbore equipment.

The integral casing unit of the invention includes an inner tubular member 15 concentrically spaced from the outer tubular member 14. The inner tubular 15 has terminal ends substantially coincident with the outer tubular member terminal ends. The material selected for the inner tubular may be the same as the outer tubular. However, the inner member will typically be selected from higher strength material since it operates at the highest well temperatures and stress.

The inner and outer tubular conduits are joined by a weldment 16 in the form of a thrust cone designed to form suitable end configurations for couplings with subsequent casing sections in making up the casing string for lining the wellbore.

The annulus cavity between the inner and outer tubular members is filled with an insulating material 17. The insulation may be of any suitable type, such as glass or ceramic fiber, layered with integral aluminum foil wraps and the like. The insulation may simply be a gettered vacuum with aluminum radiation shields. The insulation material may include an inert gas backfill.

In forming the casing string, each casing 10 is abuted end-to-end with the next casing and joined together by means of a standard coupling 18 which threadably engages threads cut into the external surface at each end of the casing outer tubular member 14. Of course, other coupling systems may be used and are within the scope of the invention. The gap created between coupled sections in the casing string is insulated by means of a coupling insulator 19 which typically includes suitable insulation material. A shield member 20 engages the thrust cones 16 on each casing section to prevent well fluids from impinging upon the coupling insulation 19.

A key feature of the invention is pre-stressing the insulated casing before it is installed in a wellbore casing string. The pre-stressing of the invention is designed to avoid structural failure of casing tubular members or of the seal between the casing and wellbore grout. Such failures would otherwise be caused by the stresses generated by thermal elongation of the tubular members when subjected to high temperature well fluids. Pre-stressing or preloading of joints within a string may be varied depending upon the optimum preload required for a particular joint position in the string.

The insulated casing of the invention is intended for usage where an inner tubular member is contacted with steam at 450°–700° F., or other such relatively hot fluids. In a well of 2,000 foot depth, operating at 600° F., linear thermal expansion of a standard oil field grade tubular member is on the order of 6–8 feet. Without pre-stressing, such expansion of a tubular member confined at both ends would result in a buckling failure.

The pre-stressing of the invention requires selecting a tubular material having a yield strength as a function of temperature characteristic such that the tubular member may be tensioned at manufacturing or ambient temperature, whereby the restrained tubular, installed in the casing string and under compression due to linear thermal expansion at well operating temperature, only approaches the tubular yield strength by an acceptable margin of safety.

In a preferred manufacturing process, the inner and outer tubular members of the casing are joined by a thrust cone weldment 16 at one end of the casing unit. A mechanical load is then applied to the opposite, terminal end of the inner tubular unit 15. The loading is selected at a level below the tension yield level of the tubular member. The tensioning load must be sufficient such that when the finished casing is subjected to well operating loads, wherein the inner tubular member is typically under compression forces due to linear thermal elongation and well operating pressures, no inner tubular member experiences a compression force at the bottom of the casing string that exceeds its compression yield strength. Once the inner tubular member is appropriately tensioned, then the final thrust cone weldment is welded in place, permanent joining the inner and outer tubular members.

Other methods of pre-tensioning may be used such as heating the inner or cooling the outer tubulars before the final weld is made. Additionally, the tubulars may be pre-tensoned after all closeout welds have been made by expanding the inner tubular or swagging the outer tubular.

The preferred casing unit at ambient or manufacturing temperatures is thus pre-stressed with the inner tubular member under tension and the outer tubular member under compression stresses. Once the casing unit becomes a component of the casing string and is cemented in place and the inner tubular member heated to operating temperatures and pressures, the stresses on the inner tubular member will result in the inner tubular member being under compressive stresses. The outer tubular member, insulated from the inner member by the insulating material and insulating couplers, will remain at about ambient temperature or whatever temperature prevails at the wellbore. The temperature differential experienced by the outer tubular member through contact with the adjacent formations and stress transmitted by the weldments from the inner tubular will be within the range that the tubular members can accommodate without significantly deforming or separating from the wellbore cement bond.

Referring to FIG. 2, the insulated casing of the invention is shown rigidly bonded by cement in a wellbore that extends down to an oil reservoir. The insulated casing of the invention permits alternatively injecting steam into the formation and extracting the resulting fluidized oil components without removal of the steam injection tubulars. No downhole packers or sealing systems are necessary to avoid reverse temperature differential conditions which have caused pre-stressed tubular steam injectors of the past to fail. The outer tubular member of the casing, in contact with the formation, remains essentially at formation temperature, and thus is not subjected to excessive thermal stresses. The pre-stressing arrangement of the inner tubular member in contact with the steam is such that the compressive forces to which it is subjected through linear thermal expansion, are less than the compressive yield strength of the inner tubular member by a desired safety margin.

EXAMPLE I THERMAL ANALYSES

Thermal analyses comparing projected heat losses from the insulator casing of the invention with uninsulated bare casing demonstrate the heat conservation advantages of the invention. Many well operations continue to run uninsulated tubular strings down the well to deliver steam into a formation. These systems may include packers designed to exclude well operating fluids form the delivery tube casing annulus. However, the temperature that the casing experiences is substantially that of the exterior of the uninsulated steam delivery tube. Thus, for approximately 600° steam, the interior casing of the uninsulated delivery system is assumed to be 600° F. and, taking into account the insulating qualities of the cement bonding the casing to the wellbore, 438° F. at the formation cement interface. The couplings are assumed to be at 600° F. and the formation temperature 460° F. For the insulated casing of the invention, the interior tubular surface temperature is at the 600° temperature of the steam with which it is in contact. The casing/cement interface, due to the character of the casing insulating material, is at 68.2° while the cement/formation interface is at 65.7°. The couplings being less efficiently insulated, include a casing/cement interface of 305° F. and a cement/formation interface of 241° F. In each case, calculations were made assuming an outer tubular member casing of 4.5 inches outer diameter (OD), cemented into an 8-inch OD wellbore. The inner diameter (ID) of the insulated inner tubular member of the insulated casing of the invention is about 2 inches in diameter, while the base casing ID is 4.0 inches. The calculation employs steam input at 1600 psig, 600° F., 80% quality, and at a flow rate of 500 barrels per day for 365 days per year. The average formation temperature is assumed to be 60° F.

TABLE I

| | INSULATED CASING | BARE CASING |
|---|---|---|
| STEAM | | |
| DELIVERED WELLHEAD [BTU/HR] | 7,736,292 | 7,736,292 |
| ENTHALPY WELLHEAD [BTU/Lb] | 1,059 | 1,059 |
| DELIVERED DOWNHOLE BTU/HR | 7,667,167 | 6,172,520 |
| ENTHALPY DOWNHOLE [BTU/Lb] | 1,051 | 845 |
| QUALITY DOWNHOLE [%] | 78 | 40 |
| TEMPERATURE DWNHOL [F] | 607 | 613 |
| PRESSURE DWNHOL [PSI] | 1,642 | 1,708 |
| TEMPERATURES | | |
| CASING OD (°F.) | 68.2 | 600.0 |
| CASING OD AT CPLNG (°F.) | 305.0 | 600.0 |
| CEMENT OD (°F.) | 65.7 | 437.7 |
| CEMENT OD AT CPLG (°F.) | 241.3 | 459.7 |
| HEAT LOSSES | | |
| TOTAL HEAT LOSS BTU/HR | 59,124.54 | 1,563,772.00 |
| TOTAL HEAT LOSS PERCENT | 0.76 | 20.21 |

EXAMPLE II STRUCTURAL ANALYSES

Calculations were made to determine the resultant stresses exerted upon tubular members of the casing of the invention and a conventional uninsulated single tubular casing at typical well operating conditions. Conditions that impact stress design are casing string length (well depth), downhole steam temperature and pressure, temperature at manufacture, and the like. Safety factors are determined for each condition, calculated by dividing the known tubular strength characteristic for the type of steel employed at the operating temperature of interest by the expected combined stress due to axial loading and the steam pressure differential employed.

Stresses are determined for an insulated casing of the invention that includes a $4\frac{1}{2}$ inch OD, 0.25 inches thick outer tubular member of API K55 steel and a $2\frac{3}{8}$ inch OD, 0.19 inch thick inner tubular member of API N80 steel. These steels have material mechanical properties at selected temepratures as shown in Table II below. The well depth chosen for the calculation is 2,000 feet and steam at 2,500 psig, producing a steam temperature of about 600° F. is employed. Each of the individual casing units is 40 feet in length. It is assumed that the entire length of the 2,000 foot casing string is bonded rigidly by cement adhesive to the adjacent rigid formation. In manufacturing the insulated casing of the invention, each section is pre-stressed by mechanically loading the inner tubular member with 40,000 pounds. The tension loadings and stresses resulting from installation and operating conditions are presented in Table III for both the insulated casing of the invention and a plain uninsulated single tubular casing.

TABLE II

| TUBULAR MECHANICAL PROPERTIES | | | | | |
|---|---|---|---|---|---|
| Inner Tubular - N80 | | | Outer Tubular - K55 | | |
| TEMP (F) | YIELD (PSI) | UTL (PSI) | TEMP (F) | YIELD (PSI) | UTL (PSI) |
| 70 | 80,160 | 100,425 | 70 | 55,000 | 96,629 |
| 600 | 63,093 | 89,182 | 130 | 53,695 | 95,873 |
| | | | 200 | 52,174 | 94,764 |

TABLE III

| SUMMARY OF STRUCTURAL ANALYSIS | | | | | | | | | |
|---|---|---|---|---|---|---|---|---|---|
| | | | | INSULATED CASING | | | | | |
| | PLAIN CASING | | | Inner Tubular | | | Outer Tubular | | |
| CONDITION | $P_i$ | | $\sigma_i$ | $P_2$ | | $\sigma_i$ | $P_o$ | | $\sigma_o$ |
| As Manufactured, 70° F. | — | | — | 40.0 | | 30.6 | −40.0 | | −12.0 |
| As Installed, 70-150° F. and Cemented into Well | 29.0 | top | 8.7 | 49.2 | top | 37.7 | −16.2 | top | −4.9 |
| | 0 | btm | 0 | 40.0 | btm | 30.7 | 40.0 | btm | −11.9 |
| Startup (Operating Condition) | | | | | | | | | |
| 600° F. Max., | −324.0 | top | −97.3 | −62.9 | top | 48.2 | 81.2 | top | 24.3 |
| Δt 530° F. | −354.0 | btm | −106.0 | −70.9 | btm | −54.4 | 57.8 | btm | 17.3 |

P = axial loading in × 1000 lbs.
σ = total stress × 1000 psi
i = inner tubular member
o = outer tubular member
Negative numbers indicate compression stress.

Referring to Table II, the yield strength of the N80 inner tubular material is 63,093 psi at 600° F. As reported in the first column of Table III, at startup and operating conditions, 600° F. steam is injected into the hole in contact with the casing. The total stress at the bottom member of the plain uninsulated casing string would be 106,000 psi, a compression stress that exceeds the yield strength of the material. The result would be a buckling structural failure of the casing or separation of the casing from the wellbore grout.

In the insulated casing of the invention, at startup and operating, the maximum combined stress on the bottom tubular, due to both axial loading and pressure differential exerted by the steam pressure on the pipe, is 54,416 psi, which does not exceed the N80 tubular steel yield strength of 63,093 psi at 600° F. This represents a safety factor of 1.16 with respect to yield strength. Comparing the Table II ultimate failure value of 89,183 psi with this stress value, shown an ultimate safety factor of 1.64.

Increasing the string load, that is the depth of the well, and resulting hydrostatic pressure increase, results in increased stress in both the inner tubular and outer casing. Increasing the temperature at which tensioning stress is introduced into the insulated casing at the time when the casing is cemented into the wall, improves the safety factor with respect to yield analysis. For example, increasing the yield strength installation temperature from 70° F. to the downhole temperature of 150° F. increases the safety factor at the bottom of the string from 1.16 to 1.41.

From the foregoing, it will be appreciated that, although embodiments of the invention have been described herein for purposes of illustration, various modifications may be made without deviating from the spirit and scope of the invention. Accordingly, the invention is not limited except as by the appended claims.

We claim:

1. An insulated wellbore casing adapted to be cemented to the surrounding earth of a wellbore, comprising:

an outer tubular member adapted to be cemented to the surrounding earth of the wellbore;

an inner tubular member, concentrically spaced from said outer tubular member, having terminal ends substantially adjacent said outer tubular member and providing an insulating annular cavity therebetween;

insulation material filling said annular cavity between said inner and outer tubulars; and weldments that join said outer and inner tubular members with said insulation held therebetween, said weldments joined while said inner tubular member is tensioned, whereby an integrated casing unit is formed that is pre-stressed to accommodate linear thermal expansion of said inner tubular member at well-operating temperatures.

2. The casing of claim 1 wherein said inner tubular tensioning stress is less than the yield strength of said tubular but sufficiently such that at operating temperature, wherein said tubular is under compression stress, said compression stress of said inner tubular is less than the compression yield strength.

3. The casing of claim 1 wherein said pre-stressed tensioning is achieved by welding together one end of the adjacent inner and outer tubular members, tubular ends, restraining said welded end from movement, mechanically loading a force on the unsecured inner tubular member until the desired tensioning stress is imparted to said inner tube and welding together said inner and outer tubular members at the tensioned end of said casing such that said inner tubular member is tensioned and said outer member is compressed, whereby said casing, when elevated to operating temperature, does not exceed tubular yield strengths.

4. The casing of claim 1 wherein said wellbore casing is tensioned for operating temperatures of 450°-700° F.

5. An insulated structurally integrated wellbore casing, comprising:

an outer tubular member, bonded to a wellbore formation along its outer surfaces;

an inner tubular member, concentrically spaced from said outer member, forming an annular cavity between said inner and outer tubular members;

insulation material filling said annular cavity between said inner and outer tubular members; and weldments that join said inner and outer tubular members, said inner tubular member joined to said outer tubular member while said inner tubular member is subjected to tensioning stress relative to said outer tubular member such that, at well operating temperatures, said inner tubular member thermal elongation causes said inner tubular member to become compressed and said outer tubular member is tensioned, whereby total stress exerted upon said casing does not exceed yield strength of said tubular members at any point.

6. The casing of claim 5 wherein said inner tubular members is pressurized with steam and said well operating temperature is at 450°–700° F.

7. The wellbore casing of claim 5 wherein a series of insulated casings are joined together end-to-end by an insulated coupling, said joined casings rigidly bonded substantially along the entire outer length of said outer casing tubular member to substantially the entire depth of the wellbore formation.

8. A method of steam injecting a downhole oil bearing formation in a wellbore, comprising:

forming an insulated casing by axially elastically elongating and joining an inner tubular to an outer tubular and allowing the inner tubular joined to the outer tubular to partially axially shorten to transfer a compressive load to the outer tubular, insulating the space therebetween;

cementing the casing to the earth surrounding the wellbore; and introducing steam within the wellbore to contact the casing inner tubular thereby elastically elongating the inner tubular significantly while holding the outer tubular due to its cemented affixation to the wellbore earth to create a compression load on the inner tubular but within its elastic limit.

* * * * *